US007344121B1

(12) United States Patent
Pan

(10) Patent No.: US 7,344,121 B1
(45) Date of Patent: Mar. 18, 2008

(54) END SURFACE GEAR-TYPE OVERLOAD PROTECTION DEVICE FOR MANUALLY OPERATED HOISTS

(76) Inventor: I-Te Pan, 5F.-2, No. 212, Sec. 1, Wunsin Rd., Taichung City (408) (TW)

( * ) Notice: Subject to any disclaimer, the term of this patent is extended or adjusted under 35 U.S.C. 154(b) by 0 days.

(21) Appl. No.: 11/725,083

(22) Filed: Mar. 19, 2007

(30) Foreign Application Priority Data

Feb. 14, 2007 (TW) ..... 96202806 U

(51) Int. Cl.
*B66D 1/14* (2006.01)

(52) U.S. Cl. ..... 254/346; 254/350; 254/358; 254/372

(58) Field of Classification Search ..... 254/346, 254/347, 350, 356, 357, 358, 372
See application file for complete search history.

(56) References Cited

U.S. PATENT DOCUMENTS 4,103,872 A * 8/1978 Hirasuka ..... 254/356
4,348,011 A * 9/1982 Honda ..... 254/350
6,224,039 B1 * 5/2001 Okamoto et al. ..... 254/346

* cited by examiner

*Primary Examiner*—Emmanuel M Marcelo

(57) ABSTRACT

An end surface gear-type overload protection device for manually operated hoists that utilizes a disc-shaped spring to control tension such that when the gears are in a leftward rotation and engagement, operation continues normally. However, during rightward rotation and the disabling thereof is instructed due to the clutch-type ratchet overload protection device, when in the "overload prevention" operations mode, if the set load of the disc-shaped spring is exceeded, the clutch-type gear wheel after sensing such allows the operating lever to spin in neutral and thereby discontinue operation. Additionally, it is possible to simply adjust the operating configuration to the "non-overload prevention" operations mode to conduct operation under overload conditions.

7 Claims, 10 Drawing Sheets

END SURFACE GEAR-TYPE OVERLOAD PROTECTION DEVICE FOR MANUALLY OPERATED HOISTS

BACKGROUND OF THE INVENTION

1) Field of the Invention

The invention herein relates to mechanical rotation safety protection mechanisms, specifically an end surface gear-type overload protection device for manually operated hoists.

2) Description of the Prior Art

Conventional manually operated hoist structures are categorized into two types: hand crank type or hand chain type, wherein the "hand crank type" hoist, as shown in FIG. 13, is comprised of a load pulley wheel 2 ensconced along with a bearing device between a pair of side plates 1 as well as an operating drive component 3 disposed at the outer lateral extent of the side plates 1 that drives a transmission shaft 4 accompanied by a gear reduction mechanism 5 at its axial lateral extent, said drive component 3 consisting of a hand crank arm 3*a* having a single-direction drive ratchet wheel 3*b*, a pawl 3*c*, and a pawl spring 3*d* such that the rapid operation of the hand crank arm 3*a* turns the drive shaft 4 which pulls over said load pulley wheel 2 a chain 6 connected to a hoisting hook 6*a* coupled to a heavy object; the "hand pull type" hoist, as shown in FIG. 14, generally consists of, in common with the hand crank type structure, side plates 1, a load pulley wheel 2, a transmission shaft 4, a gear reduction mechanism 5, a chain 6 connected to a hoisting hook 6*a*, and other necessary drive components, the difference is that the power input section drive component 7 is instead a hand pull chain 7*a* and at its lateral axial aspect has a direction alternating ratchet wheel 8 and a pawl 8*a* which replaces the drive component 3 of said hand crank type structure, the hand pull type variant utilizing the hand pull wheel 7 over which is diametrically disposed a hand pull chain 7*b* to draw and thereby operate, at the other end of the transmission shaft 4, a load pulley wheel 2 and its chain 6 connected to a hoisting hook 6*a* coupled to a heavy object; since the hand crank type and the hand pull type structures are uncomplicated, portable, and convenient, they are widely used for loading cargo, unloading cargo, and strapping cargo. As such, in keeping with their operating characteristics, they are often utilized in an overloaded state and there is no limiting overload setting which, especially when lifting and strapping loads, tends to concentrate hoisting load stress at certain points, the hoisting hook 6*a* easily subjecting the chain 6, brake, and other components of the hoist to excessive wear, while also easily damaging goods and causing industrial accidents wherein operating personnel suffer injury.

SUMMARY OF THE INVENTION

The primary objective of the invention herein is to provide an end surface gear-type overload protection device for manually operated hoists, providing a hand crank type hoist or a hand pull type hoist that, in view of overload incurred wear or accidents attributed to such hoists in the past, integrates a safety device that senses a preset overload weight and, furthermore, automatically halts operation to thereby prevent hoisting rig damage and operating personnel industrial injury and accidents.

The unique features of the structure herein includes the utilization of a disc-shaped spring to control tension such that during leftward gear rotation and enmeshment normal operation continues, but during rightward rotation when instructions cannot be executed by the clutch-type gear installed to prevent overload and the invention is in the "overload prevention" operating mode, if the set load of the disc-shaped spring is exceeded, the clutch-type gear after sensing such allows the operating shaft to spin in neutral continuously. Additionally, said structure can be simply adjusted to a "non-overload prevention" operating mode to thereby permit operation under overload conditions.

As such, the end surface gear-type overload protection device for manually operated hoists of the invention herein is a structure capable of utilization in either a hand crank type hoist or a hand pull type hoist to provide such manually operated hoists a practical means of overload control.

DETAILED DESCRIPTION OF THE PREFERRED EMBODIMENTS

Figure 1:
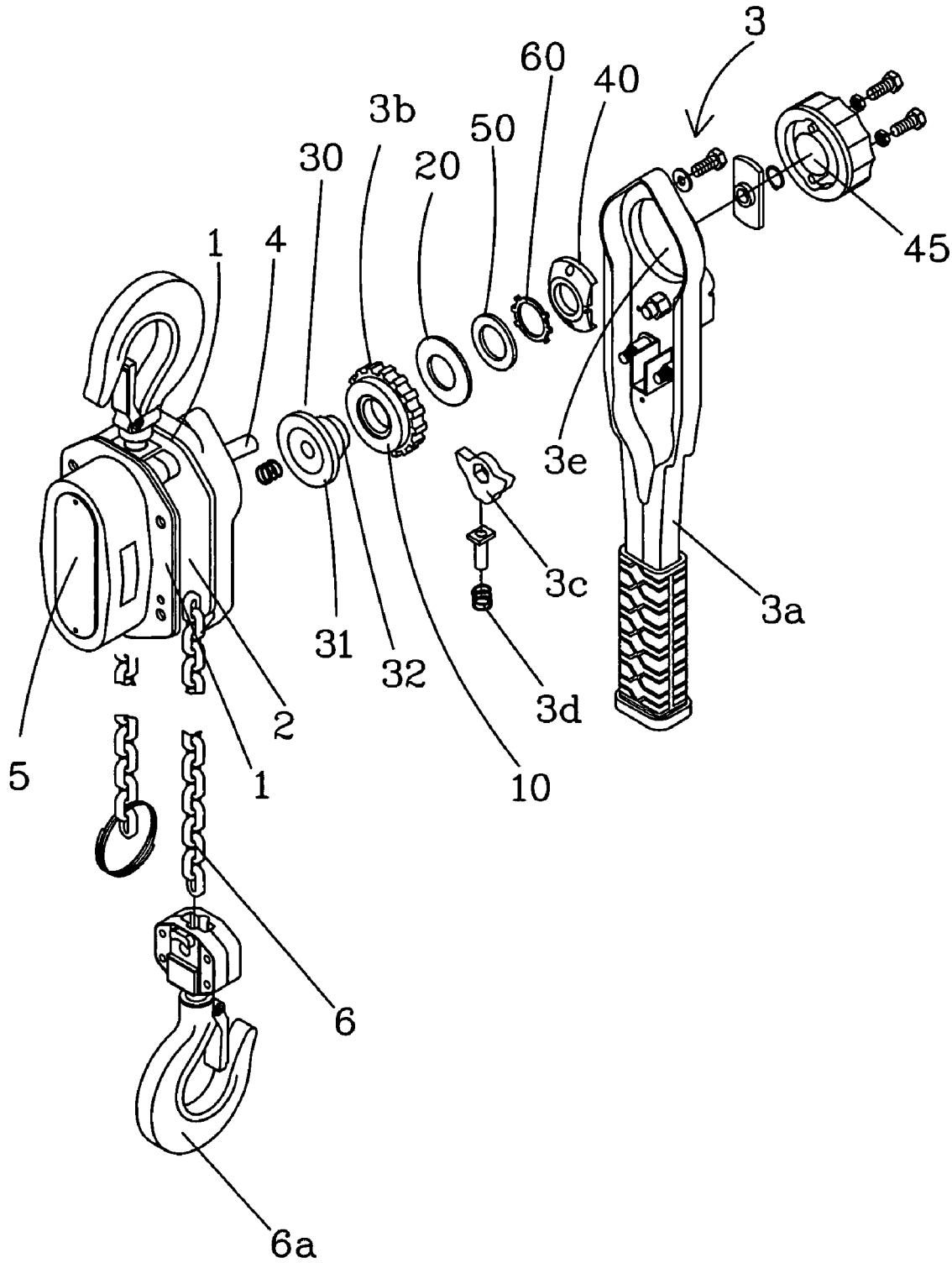
FIG. 1 is an exploded drawing of the first most preferred embodiment of the invention herein.
Figure 2:
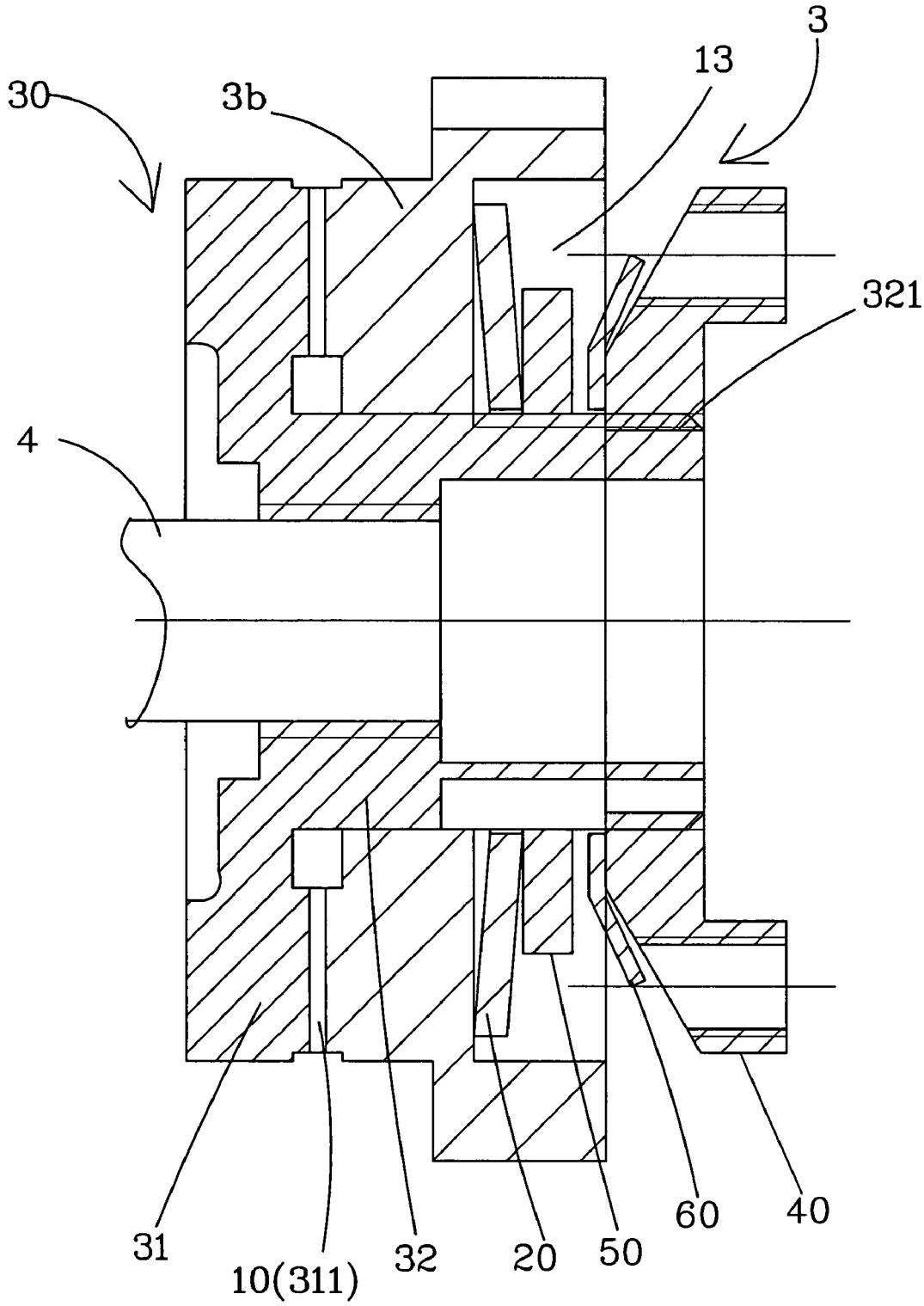
FIG. 2 is a cross-sectional drawing of FIG. 1, showing a partial aspect in magnified view.
Figure 3:
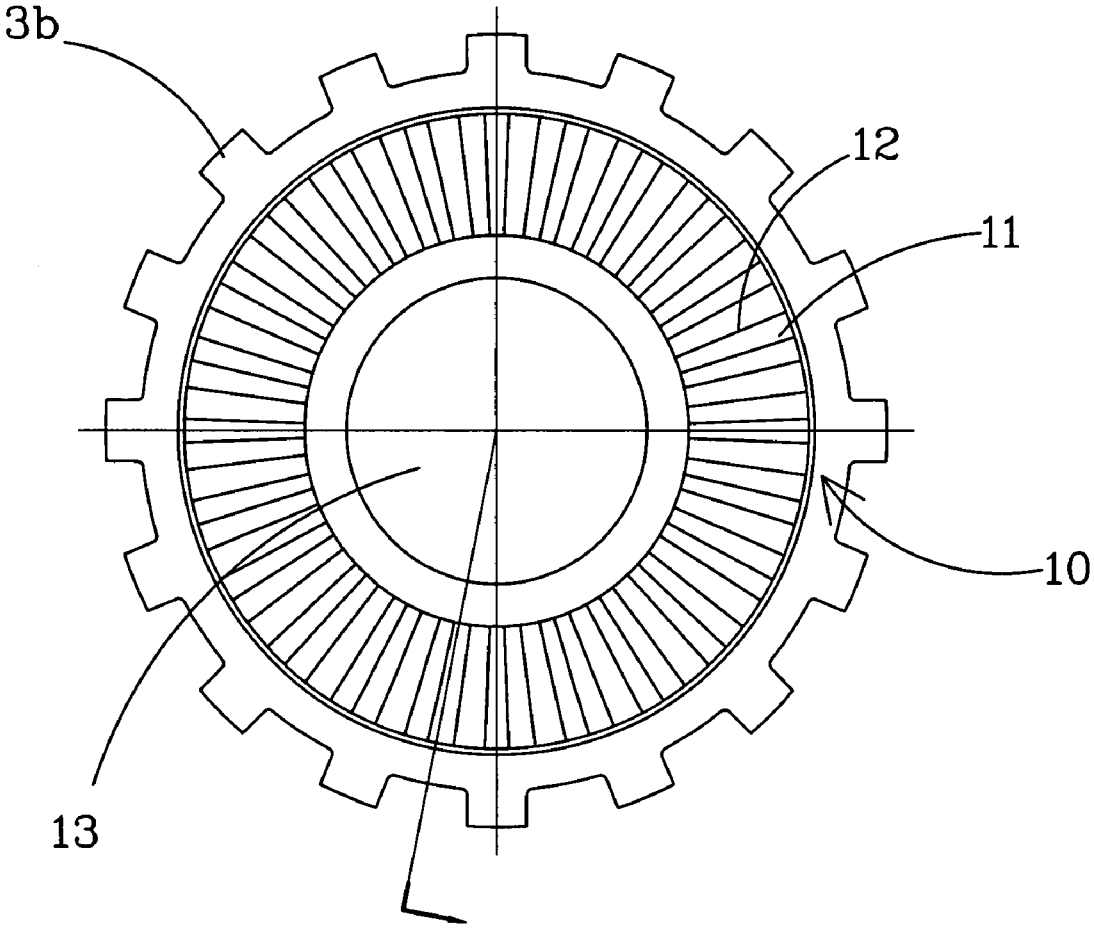
FIG. 3 is an orthographic drawing of the drive component, umbrella type gear ring of the invention herein.
Figure 4:
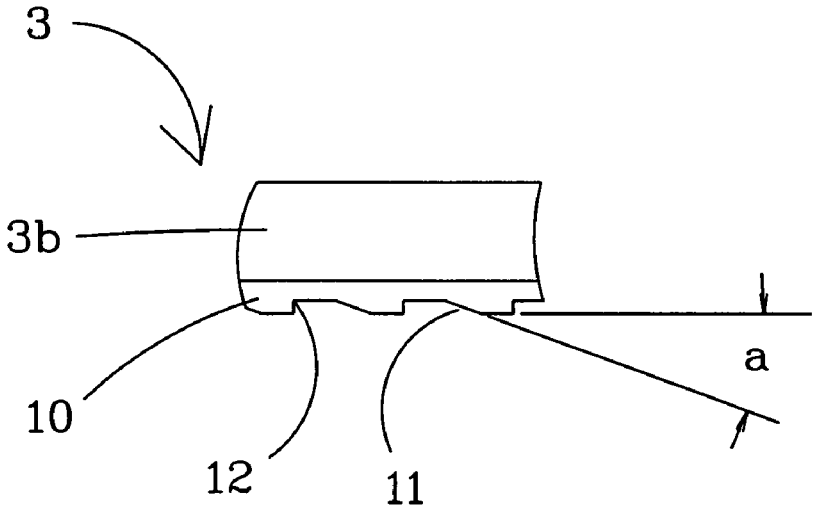
FIG. 4 is an orthographic drawing of the drive component, umbrella type gear ring of the invention herein.

To elaborate the "manual crank type" hoist structure of the present invention, as indicated in FIG. 1 and FIG. 2, the invention herein is comprised of two side plates 1, a load pulley wheel 2, a drive component 3, a transmission shaft 4, and a gear reduction mechanism 5, with a hand crank arm 3*a* that is turned rapidly to impel the transmission shaft 4, thereby causing the load pulley wheel 2, on which is mounted a chain 6, to draw a connected hoisting hook 6*a* coupled to a heavy object; since this aspect of the arrangement is identical with that utilized conventionally, it shall not be further described; the original design feature of the invention herein is that the drive component 3 ratchet wheel 3*b*, at its lateral area of rotation, includes an umbrella type gear ring 10, an elastic component 20, a drive sleeve 30, an adjustment nut 40, an equalizing washer 50, and a locating ring 60 in a insertional spatial arrangement, the unique features of which include:

Referring to FIG. 1 and FIG. 2, the umbrella type gear ring 10 and the ratchet wheel 3*b* end surface constituted into a single structural entity, the end surface consisting of slanted facets 11 postured at a predetermined angle and, as indicated in FIG. 3 and FIG. 4, the optimal angle α of each slanted facet 11 is 20 degrees, while situated perpendicularly at the terminus of each slanted facet 11 is a land section 12, and reticulated axially at the rear end of the drive component 3 ratchet wheel 3*b* is a recess 13.

Referring to FIG. 1 and FIG. 2, the elastic component 20 is seated in the recess 13 of the ratchet wheel 3*b* and is optimally a disc-shaped spring.

Figure 5:
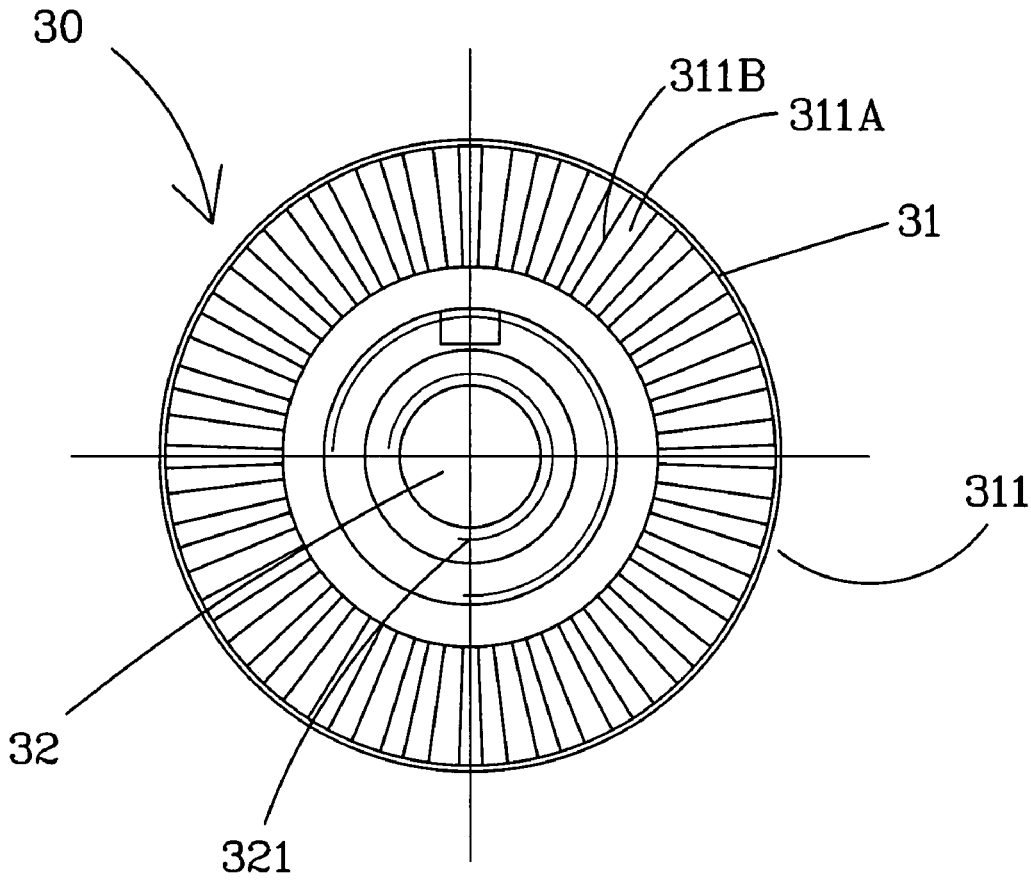
FIG. 5 is an orthographic drawing of the drive component sleeve, umbrella type teeth section of the invention herein.
Figure 6:
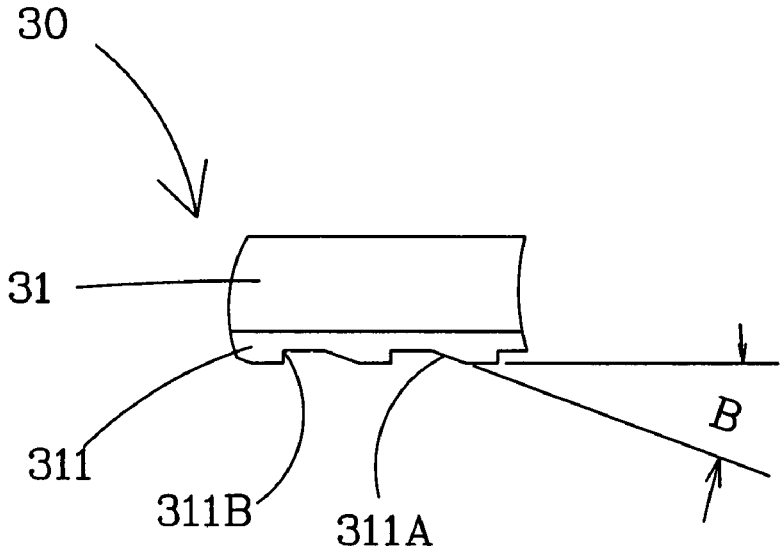
FIG. 6 is an orthographic drawing of the drive sleeve, umbrella type teeth section of the invention herein.

Referring to FIG. 1 and FIG. 2, the drive sleeve 30 is placed axially onto the transmission shaft 4, one end consists of a relatively large diameter holding flange 31 with the other end consisting of relatively narrow diameter hollow neck 32 and, as indicated in FIG. 5 and FIG. 6, the holding flange 31 has an umbrella type teeth section 311 consisting of inclined angle troughs and peaks that enmesh the umbrella type gear ring 10, the slanted facets 311A of which are each postured at a predetermined angle β, the optimum predetermined angle β of each slanted facet being 20 degrees, and situated perpendicularly at the terminus of each slanted facet 311A is a land section 311B; the hollow neck 32 is inserted axially through the umbrella type gear ring 10 and the ratchet wheel 3*b* and, furthermore, external threads 321 are died onto its extremity.

Figure 7:
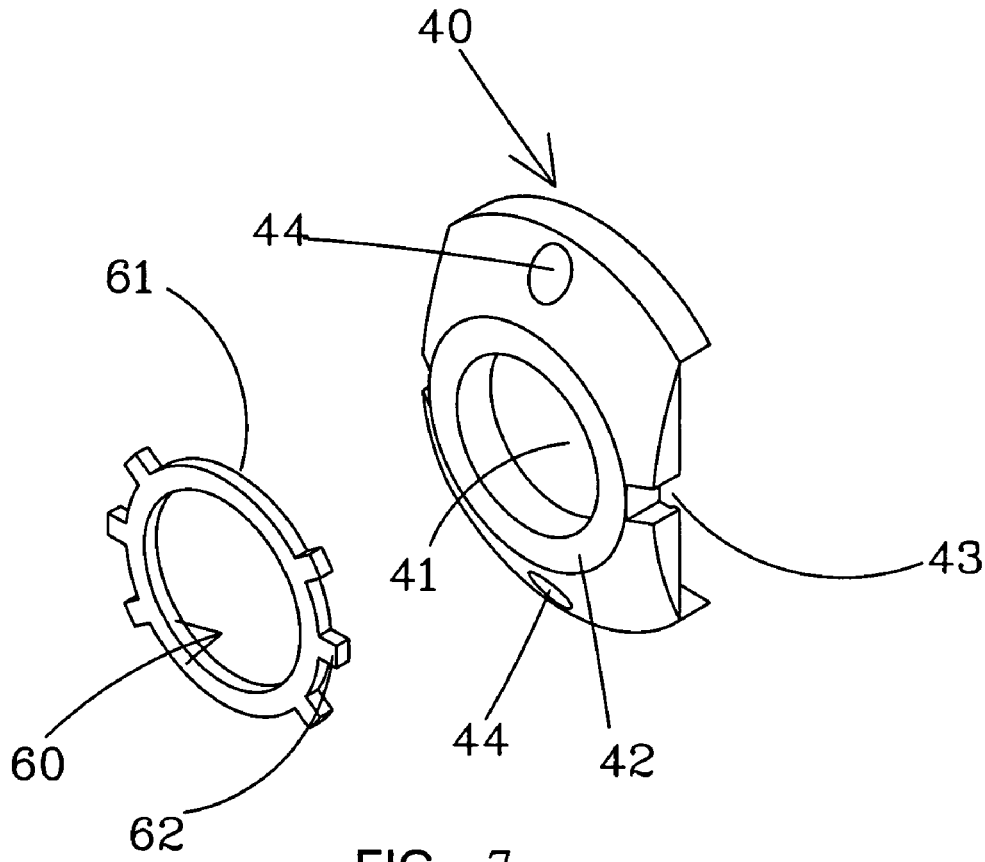
FIG. 7 is an isometric drawing of the locating ring and the adjustment nut of the invention herein.

Referring to FIG. 2 and FIG. 7, the adjustment nut 40 is a rectilinear body and, furthermore, internal threads 41 are tapped through its center for fastening onto the external threads 321 at the extremity of the drive sleeve 30; a bottoming section 42 is machined flat along the front extremity and a quantity of notches 43 are disposed along the outer circumference; and two anchoring holes 44 are drilled diametrically in the end surface to position a shaft collar bearing 45 (see FIG. 1) in the bearing hole 3*e* of the hand crank arm 3*a*.

Referring to FIG. 1 and FIG. 2, the equalizing washer 50 is an annular rigid body that is disposed pivotally at the inner sides of the elastic component 20 and the adjustment nut 40 such that when the adjustment screw 40 is tightened, it provides equalized pressure axially against the elastic component 20.

Figure 8:
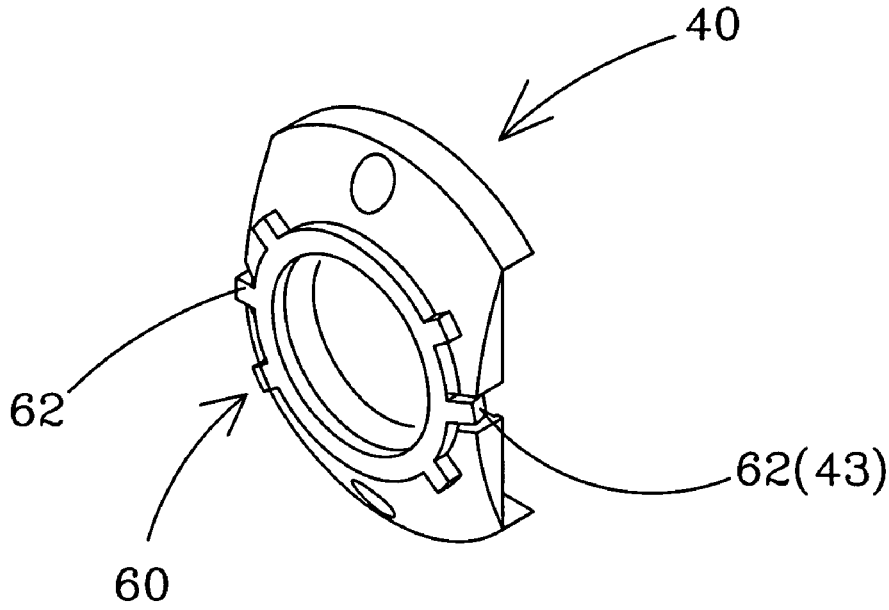
FIG. 8 is an isometric drawing of the assembled locating ring and adjustment nut of the invention herein.

Referring to FIG. 1 and FIG. 2, the locating ring 60 is an annular washer that is seated pivotally between the sides of adjustment screw 40 and the equalizing washer 50 and, as indicated in FIG. 7 and FIG. 8, has a bottoming flat surface 61 that corresponds to the bottoming section 42 along the front end of the adjustment screw 40 and, furthermore, six tabs 62 protruding towards the notches 43 to provide for the radial fixing by insertion of the adjustment screw 40 position.

Based on said assembly, the operation and utilization of the end section gear type overload protection device for manually operated hoists of the invention herein is as follows: Referring to FIG. 2, the adjustment screw 40 is fastened into the external threads 321 at the extremity of the drive sleeve 30 to axially clamp together the drive component 3 ratchet wheel 3*b*, the elastic component 20, the drive sleeve 30, the equalizing washer 50, and the locating ring 60, utilizing the adjustment screw 40 to produce axial pressure against the drive component 3 and, via the equalizing washer 50, apply balanced pressure against the elastic component 20 such that changes in its shape result in axial thrust which provides the required load torsion.

Figure 9:
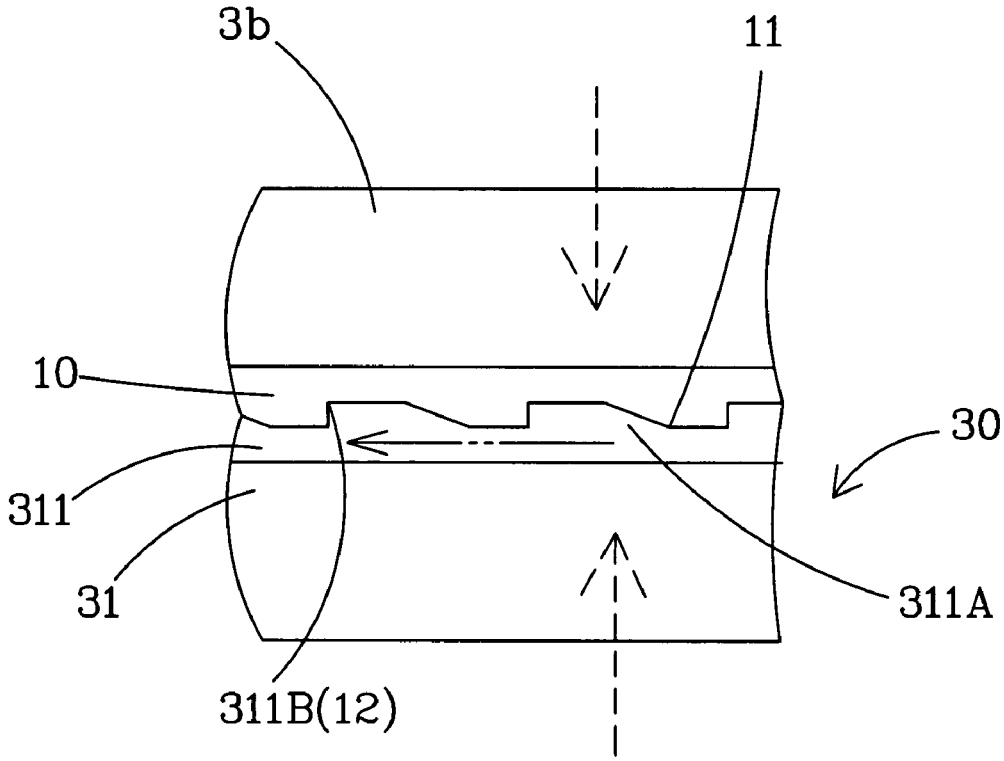
FIG. 9 is an orthographic drawing of the drive component and drive sleeve when engaged in forward rotation.
Figure 10:
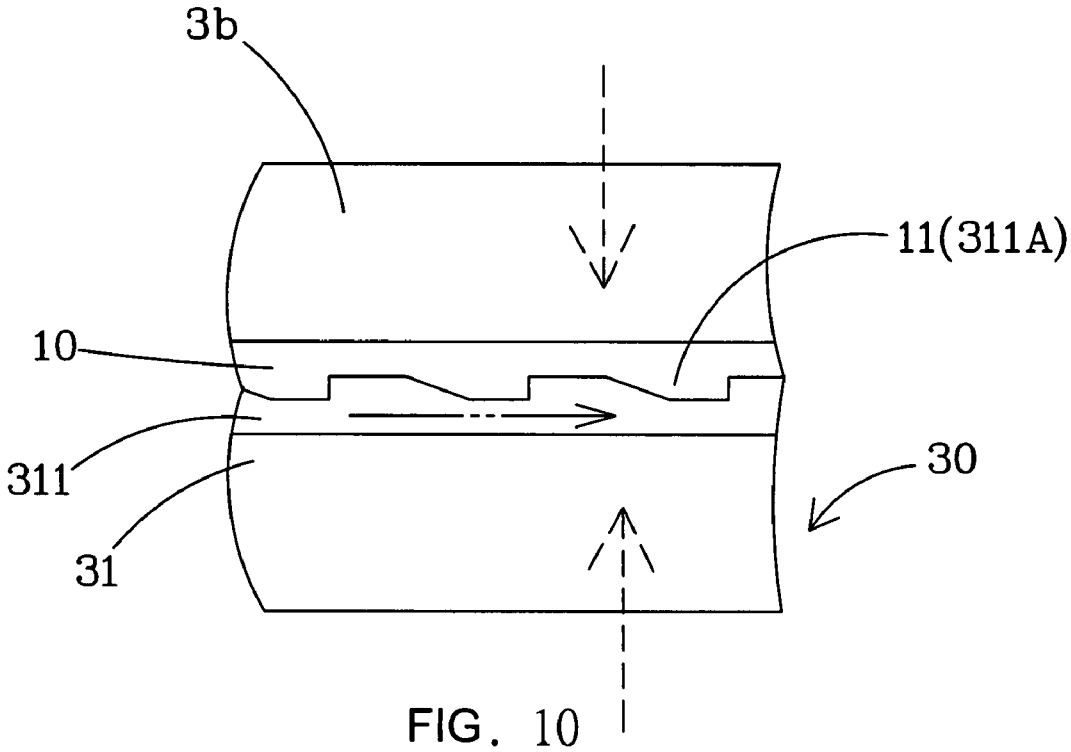
FIG. 10 is an orthographic drawing of the drive component and drive sleeve when engaged in rearward rotation.

At the same time, the skewered and clamped drive component 3 ratchet wheel 3*b* at the end surface of the umbrella type gear ring 10 enmeshes the drive sleeve 30 umbrella type teeth section 311, as shown in FIG. 9 and FIG. 10, increasing the elastic component 20 rebound force, and thereby increasing the friction laterally exerted between the umbrella type gear ring 10 and the umbrella type teeth section 311, such that the drive component 3 ratchet wheel 3*b* requires the transfer of greater torsion before slippage occurs and conversely the transfer of less torsion to readily allow slippage; when a load exceeds the set torsion of the load pulley wheel 2 at the emergent tip of the transmission shaft 4, the hand crank arm 3*a* turning the ratchet wheel 3*b* slips to protect against inputted transmission overload.

As a result, when no overload occurs during the transmission process, the ratchet wheel 3*b*, the drive sleeve 30, the equalizing washer 50, and the locating ring 60 remain clamped together and, as such, given the alternating directional operation of the hand crank arm 3*a* ratchet wheel 3*b* with a pawl 3*c*, as indicated in FIG. 9, the two land sections 311B and 12 engage perpendicularly to achieve forward rotation or, as indicated in FIG. 10, the umbrella type gear ring 10 and the umbrella type teeth section 311 slanted facets 311A and 11 engage to achieve reverse rotation operation, and with the rapid up and down movement of the hand crank arm 3*a*, the transmission shaft 4 pulls the chain 6 mounted over the load pulley wheel 2 and thereby raises the hoisting hook 6*a* coupled to a heavy object.

When an overload occurs during the transmission process, the umbrella type gear ring 10 and the umbrella type teeth section 311 slanted facets 311A and 11 that were originally pushed and squeezed against each other are then impelled laterally to disengage the land sections 311B and 12, following which they fall into another engagement with the slanted facets 311A and 11 and, as a result, umbrella type gear ring 10 and the umbrella type teeth section 311 slip apart and spin in neutral, manifesting a metallic frictional sound that informs the operator of the overload, thereby ensuring work safety.

Additionally, the hand crank arm 3*a* and the transmission shaft 4 of the invention herein, at their lateral area of rotation, includes an umbrella type gear ring 10, an elastic component 20, a drive sleeve 30, an adjustment nut 40, an equalizing washer 50, and a locating ring 60 in a insertional spatial arrangement, and although utilized to provide for "overload prevention" operations mode with a procedure for setting hoist load limits, the present invention is easily adjusted into a "non-overload prevention" operations mode, the procedure only requiring the removal of the locating ring 60 tabs 62 that were originally inserted into said notches 43, which thereby releases the fixed state of the adjustment nut 40 to accommodate specific working requirements and, as such, tasks can be performed under overload conditions if desired because the adjustment procedure is very simple.

Figure 11:
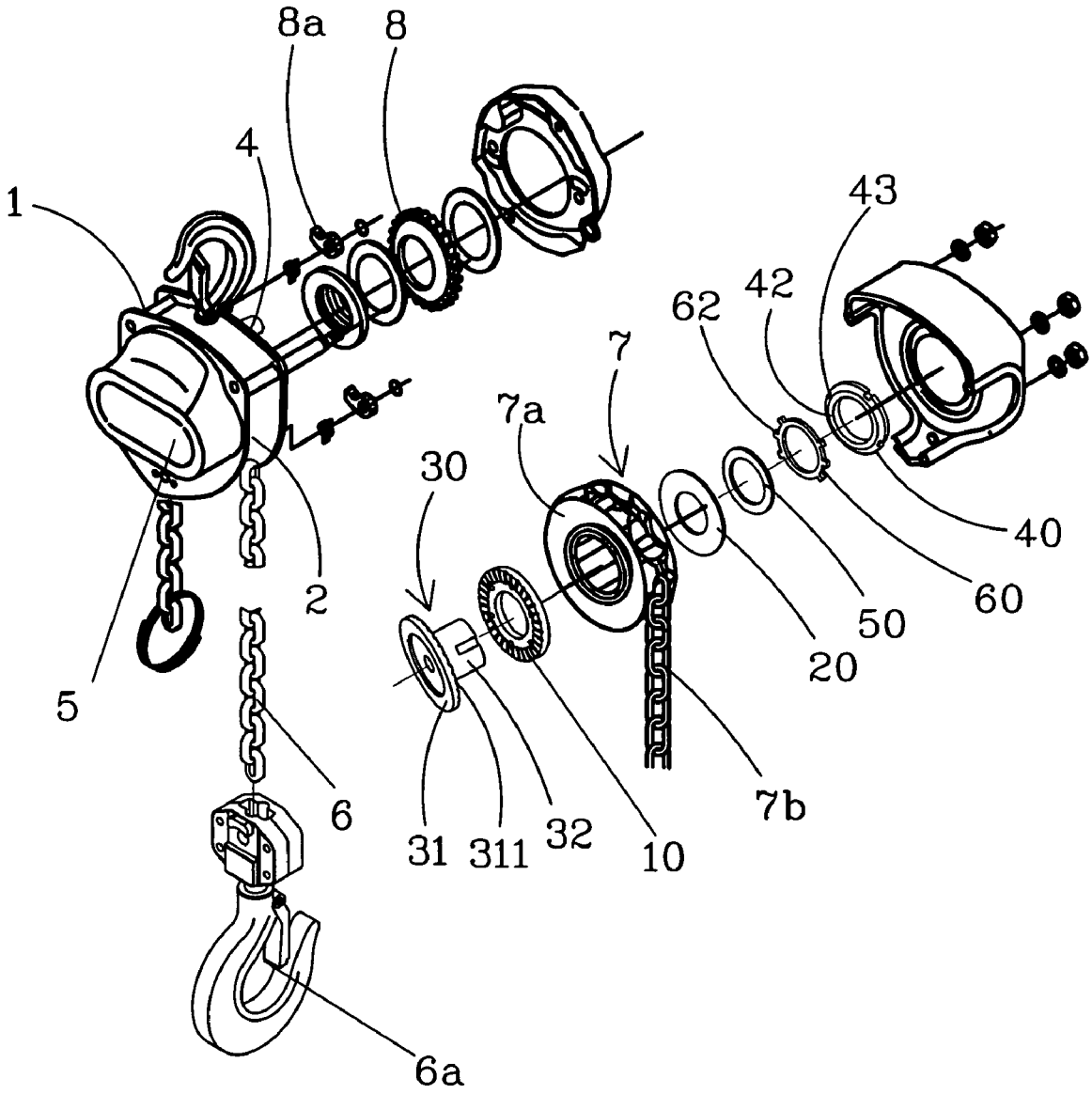
FIG. 11 is an exploded drawing of the second most preferred embodiment of the invention herein.
Figure 12:
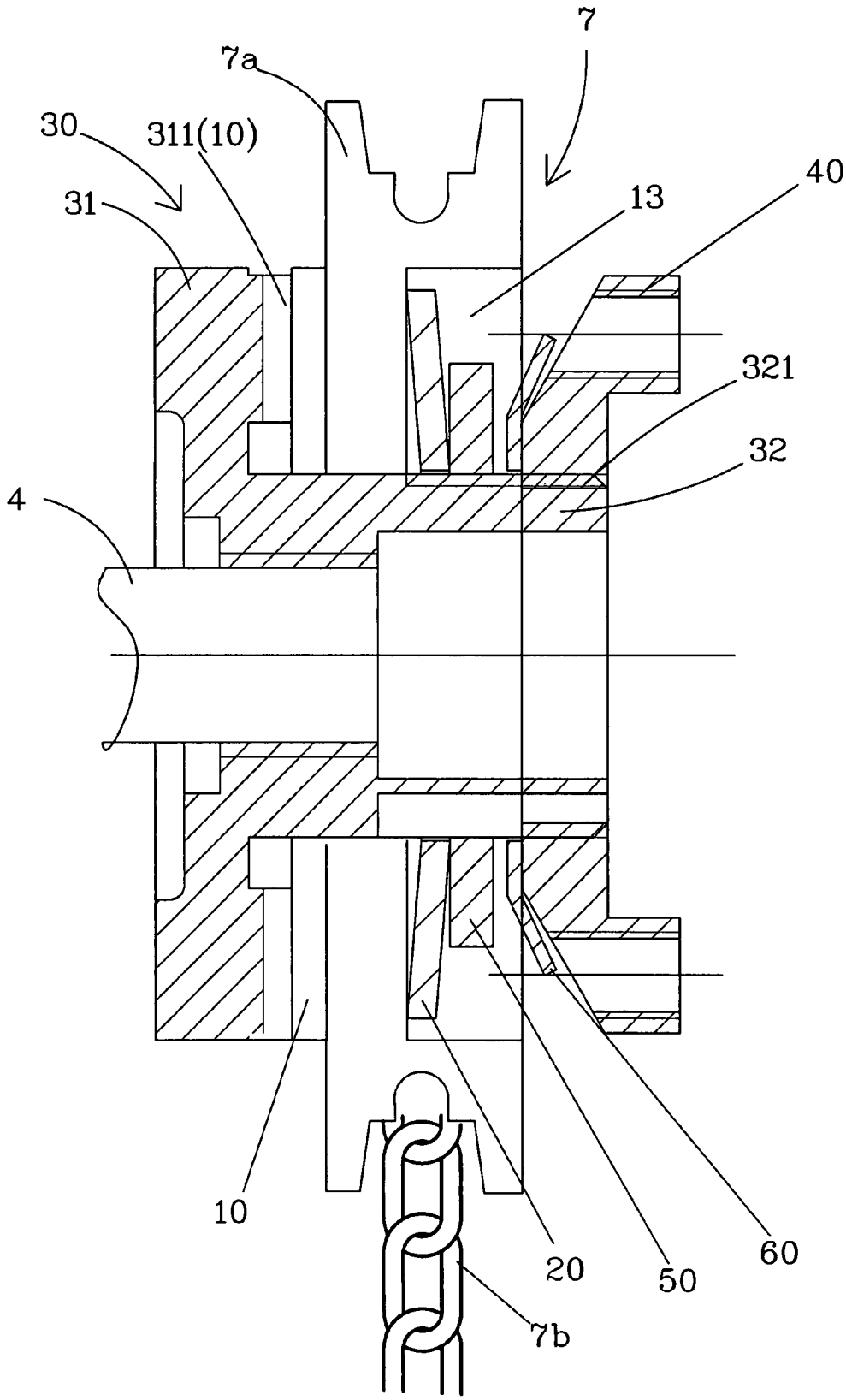
FIG. 12 is a cross-sectional drawing of the second most preferred embodiment of the invention herein, showing a partial aspect in magnified view.
Figure 13:
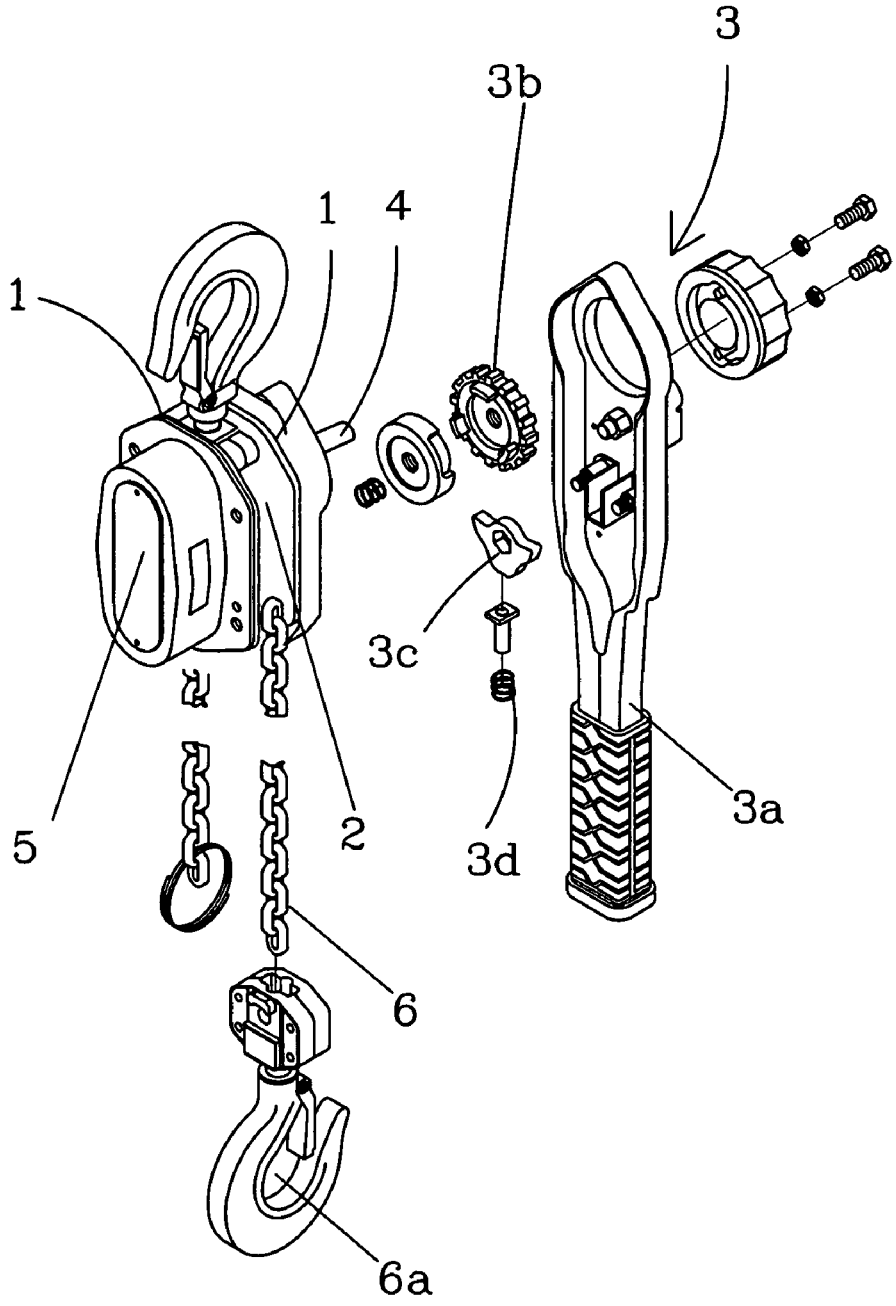
FIG. 13 Prior Art
FIG. 13 is an exploded drawing of a conventional manual crank type hoist structure.
Figure 14:
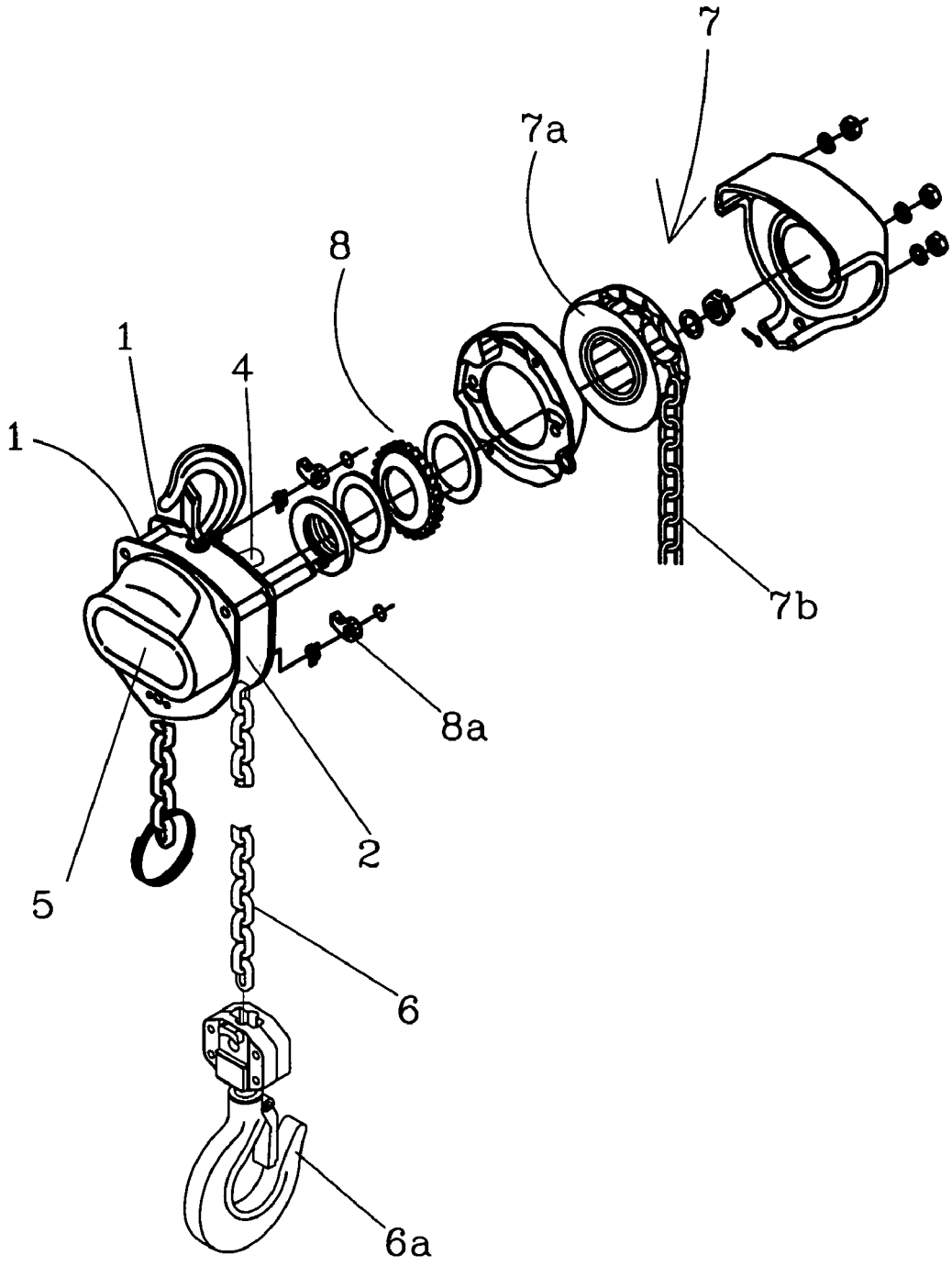
FIG. 14 Prior Art
FIG. 14 is an exploded drawing of a conventional manual pull type hoist structure.

Referring to FIG. 11 and FIG. 12, to elaborate the invention herein utilizing a "manual pull type" hoist, the present invention is comprised of two side plates 1, a load pulley wheel 2, a drive component 7, a transmission shaft 4, and a gear reduction mechanism 5, via the drive component 7 hand chain wheel 7*a* and a hand chain 7*b* that rotate and are driven on the transmission shaft 4, wherein a chain 6 mounted over the load pulley wheel 2 draws a connected hoisting hook 6*a* coupled to a heavy object, and since these aspects of the arrangement are identical with that of conventional manual pull type hoists, they shall not be further described; however, the unique features of this embodiment are the same as those disclosed of the manual crank type hoist and includes an umbrella type gear ring 10, an elastic component 20, a drive sleeve 30, an adjustment nut 40, an equalizing washer 50, and a locating ring 60 in an insertional spatial arrangement that are respectively disposed at the axial end surfaces at the two sides of the drive component 7 hand chain wheel 7*a*.

Referring to FIG. 12, screws or rivets (not shown in the drawings) fasten the umbrella type gear ring 10 and the drive component 7 hand chain wheel 7*a* axially at the end surfaces to conjoin them into a single entity, and utilizing the drive sleeve 30 axially, the hollow neck 32 is inserted lengthwise through the hand chain wheel 7*a* and the umbrella type gear ring 10 and, furthermore, the elastic component 20, the equalizing washer 50, and the locating ring 60 are respectively and pivotally conjoined to the other lateral end of the hand chain wheel 7*a* and, finally, the adjustment nut 40 is similarly fastened tight onto the external threads 321 along the end of the drive sleeve 30 such that the drive component 7 hand chain wheel 7*a*, the elastic component 20, the drive sleeve 30, the equalizing washer 50, and the locating ring 60 are axially conjoined into a single entity; utilizing the adjustment nut 40 tightness to produce pressure against the drive component 7 and axially towards the hand chain wheel 7*a*, the equalizing washer 50 transfers balanced force against the elastic component 20, its changes in shape resulting in axial thrust that produces the required load torsion; since the structural components are insertionally conjoined such that the umbrella type gear ring 10 at the end surface of the drive component 7 hand chain wheel 7*a* is against the drive sleeve 30 umbrella type teeth section 311, as shown in FIG. 12, increasing the elastic component 20 force increases the lateral contact friction between the umbrella type gear ring 10 and the umbrella type teeth section 311, the hand chain wheel 7*a* required to transfer greater rotational torque before the onset of slippage, with the converse action requiring the transfer of less rotational torque before slippage; when the load pulley 2 at the emergent end of the transmission shaft 4 is subjected to a load that exceeds the set rotational torque, then the hand chain wheel 7*a* pulled and controlled by the hand chain wheel 7*b* slips to protect the inputted transfer from overload.

To continue, when no overload occurs during the transmission process, as indicated in FIG. 9, the land sections 311B and 12 engage perpendicularly to achieve forward rotation or, as indicated in FIG. 10, the umbrella type gear ring 10 and the umbrella type teeth section 311 two slanted facets 311A and 11 engage to achieve reverse operation, and the hand chain 7*b* pulls the transmission shaft 4 to draw a chain 6 mounted over the load pulley wheel 2 that is connected to the hoisting hook 6*a* coupled to a heavy object.

When an overload occurs during the transmission process, likewise, the umbrella type gear ring 10 and the umbrella type teeth section 311 two slanted facets 311A and 1I that were originally pushed and squeezed against each other are then impelled laterally to disengage the land sections 311B and 12, following which they fall into another engagement with the slanted facets 311A and 11 and, as a result, the umbrella type gear ring 10 and the umbrella type teeth section 311 slip apart and spin in neutral, thereafter manifesting a metallic frictional sound to inform the operator of the overload to ensure work safety.

What is claimed is:

1. An end surface gear-type overload protection device for manually operated hoists, the constituents of which include a load pulley wheel installed by clamping between two side plates via bearing devices, and in the arrangement the outer lateral extent of one said side plate provides for the manually operated input of a drive component and, furthermore, said drive component impels an axially disposed transmission shaft, thereby enabling a chain mounted on said load pulley wheel and connected to a hoisting hook to lift an object; the innovative features of the invention herein include:

said drive component has installed axially at its front end an umbrella type gear ring having predetermined inclined angle troughs and peaks, at its rear end reticulated axially is a recess, and seated in said recess is an elastic component; said transmission shaft has axially facing the umbrella type gear ring and, furthermore, rotatably installed a drive sleeve, said drive sleeve consisting of a relatively large diameter holding flange and a relatively narrow diameter hollow neck, said drive sleeve also having inclined angle troughs and peaks disposed that enmesh the umbrella type teeth section of said umbrella type gear ring; the hollow neck has axially disposed a shaft hole for inserting said drive component and, furthermore, died along its extremity are external threads on which an adjustment nut is tightened axially against said elastic component, the elastic component axial compression and decompression adjusted thereby regulating control over the enmeshment and disengagement of said umbrella type gear ring with said umbrella type teeth section; as such, the present invention achieves control and operation of manually operated hoist overload prevention.

2. An end surface gear-type overload protection device for manually operated hoists as claimed in claim 1 wherein said drive component consists of a hand crank arm that via a single-direction rotative capability ratchet wheel and a pawl, the rapid movement of the hand crank arm enables said ratchet wheel and said transmission shaft to pull the chain mounted over the load pulley wheel and thereby said hoisting hook connected to said chain.

3. An end surface gear-type overload protection device for manually operated hoists as claimed in claim 1 wherein said drive component consists of a hand chain wheel over which a chain is diametrically oriented, said hand chain wheel and chain pulling operation controlling said transmission shaft in drawing a load pulley wheel having mounted over it a chain connected to a hoisting hook.

4. An end surface gear-type overload protection device for manually operated hoists as claimed in claim 1 wherein said elastic component is optimally a disc-shaped spring.

5. An end surface gear-type overload protection device for manually operated hoists as claimed in claim 1 wherein between said elastic component and said adjustment nut and, furthermore, clamped pivotally is a rigid equalizing washer and, as such, when the adjustment screw is tightened, it provides for an action of equalized pressure exerted axially against said elastic component.

6. An end surface gear-type overload protection device for manually operated hoists as claimed in claim 1 wherein said adjustment nut has a quantity of notches disposed along its outer circumference and a locating ring is seated pivotally at the side, said locating ring has, corresponding to said notches, a minimum of one protruding tab and, as such, the tip of said tab is flexibly inserted into said notches to provide for tightly fixing the position of said adjustment nut.

7. An end surface gear-type overload protection device for manually operated hoists as claimed in claim 1 wherein said drive sleeve, umbrella type teeth section enmeshes the drive component, umbrella type gear ring, wherein the optimal angle of the two is degrees at the slanted angles and, furthermore, situated perpendicularly at the terminus of each slanted facet is a land section.

* * * * *